US011264768B1

(12) United States Patent
Monroe

(10) Patent No.: US 11,264,768 B1
(45) Date of Patent: Mar. 1, 2022

(54) OUTDOOR UTILITY STAKE

(71) Applicant: Barbara Jean Monroe, South Charleston, OH (US)

(72) Inventor: Barbara Jean Monroe, South Charleston, OH (US)

( * ) Notice: Subject to any disclaimer, the term of this patent is extended or adjusted under 35 U.S.C. 154(b) by 50 days.

(21) Appl. No.: 16/889,906

(22) Filed: Jun. 2, 2020

Related U.S. Application Data

(60) Provisional application No. 62/858,369, filed on Jun. 7, 2019.

(51) Int. Cl.
*H01R 25/00* (2006.01)
*H01R 13/73* (2006.01)
*H01R 13/447* (2006.01)

(52) U.S. Cl.
CPC ..... *H01R 25/006* (2013.01); *H01R 13/447* (2013.01); *H01R 13/73* (2013.01)

(58) Field of Classification Search
CPC .... H01R 25/006; H01R 13/447; H01R 13/73; H02G 3/088
See application file for complete search history.

(56) References Cited

U.S. PATENT DOCUMENTS 5,879,184 A * 3/1999 Lopez ..... H01R 25/006 439/502
6,273,578 B1 * 8/2001 Lai ..... F21V 21/0824 174/58
6,300,570 B1 * 10/2001 Lai ..... H01R 25/003 174/67
D460,415 S * 7/2002 Stekelenburg ..... D13/139.4
6,731,024 B1 * 5/2004 Molnar ..... H01R 13/6666 307/147
7,041,899 B2 * 5/2006 Stekelenburg ..... H01R 25/00 174/50
9,368,900 B2 * 6/2016 Lai ..... H01R 13/516
2001/0041474 A1 * 11/2001 Chien ..... H01R 25/003 439/542
2004/0092158 A1 * 5/2004 Chien ..... H01R 31/06 439/505
2014/0148024 A1 * 5/2014 Lai ..... H01R 13/52 439/135

* cited by examiner

*Primary Examiner* — Tho D Ta
(74) *Attorney, Agent, or Firm* — Kyle A. Fletcher, Esq.

(57) ABSTRACT

The outdoor utility stake is an electric distribution device that is for outdoor use. The outdoor utility stake anchors into the ground. The outdoor utility stake draws electric energy from a national electric grid. The outdoor utility stake distributes electric energy for use by one or more electrically powered devices. The outdoor utility stake forms a protected space that encloses the electric connection between the national electric grid and the outdoor utility stake. The outdoor utility stake comprises a distribution structure and a transfer circuit. The distribution structure contains the transfer circuit. The distribution structure forms the protected space used to form the protected space that encloses the electric connection between the national electric grid and the outdoor utility stake.

17 Claims, 5 Drawing Sheets

OUTDOOR UTILITY STAKE

CROSS REFERENCES TO RELATED APPLICATIONS

This non-provisional application claims priority under 35 USC 119(e) to U.S. provisional application U.S. 62/858,369 filed on Jun. 7, 2019 by the inventor: Barbara Jean Monroe of Columbus, Ohio. This non-provisional application claims U.S. provisional application U.S. 62/858,369 in its entirety.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of electricity and electrically conductive connections, more specifically, an electrical connection where a first electric element has one or more projections that electrically connect with a second electric element. (H01R4/00)

SUMMARY OF INVENTION

The outdoor utility stake is an electric distribution device. The outdoor utility stake is configured for outdoor use. The outdoor utility stake anchors into the ground. The outdoor utility stake draws electric energy from a national electric grid. The outdoor utility stake distributes electric energy for use by one or more electrically powered devices. The outdoor utility stake forms a protected space that encloses the electric connection between the national electric grid and the outdoor utility stake. The outdoor utility stake comprises a distribution structure and a transfer circuit. The distribution structure contains the transfer circuit. The distribution structure forms the protected space used to form the protected space that encloses the electric connection between the national electric grid and the outdoor utility stake. The transfer circuit electrically connects to the national electric grid. The transfer circuit transfers the received electric energy to the one or more electrically powered devices.

These together with additional objects, features and advantages of the outdoor utility stake will be readily apparent to those of ordinary skill in the art upon reading the following detailed description of the presently preferred, but nonetheless illustrative, embodiments when taken in conjunction with the accompanying drawings.

In this respect, before explaining the current embodiments of the outdoor utility stake in detail, it is to be understood that the outdoor utility stake is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the outdoor utility stake.

It is therefore important that the claims be regarded as including such equivalent construction insofar as they do not depart from the spirit and scope of the outdoor utility stake.

It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
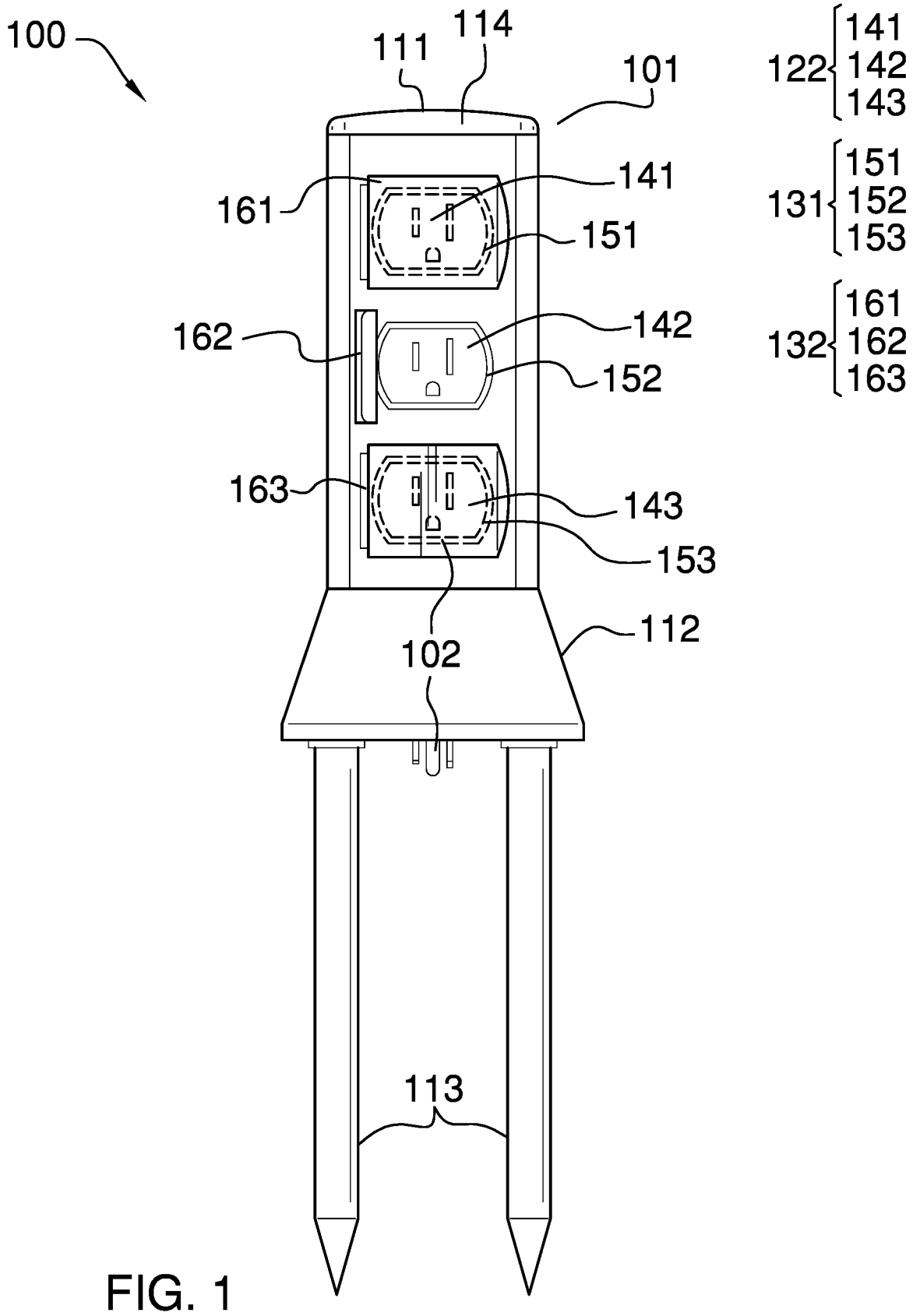
FIG. 1 is a front view of an embodiment of the disclosure.
Figure 2:
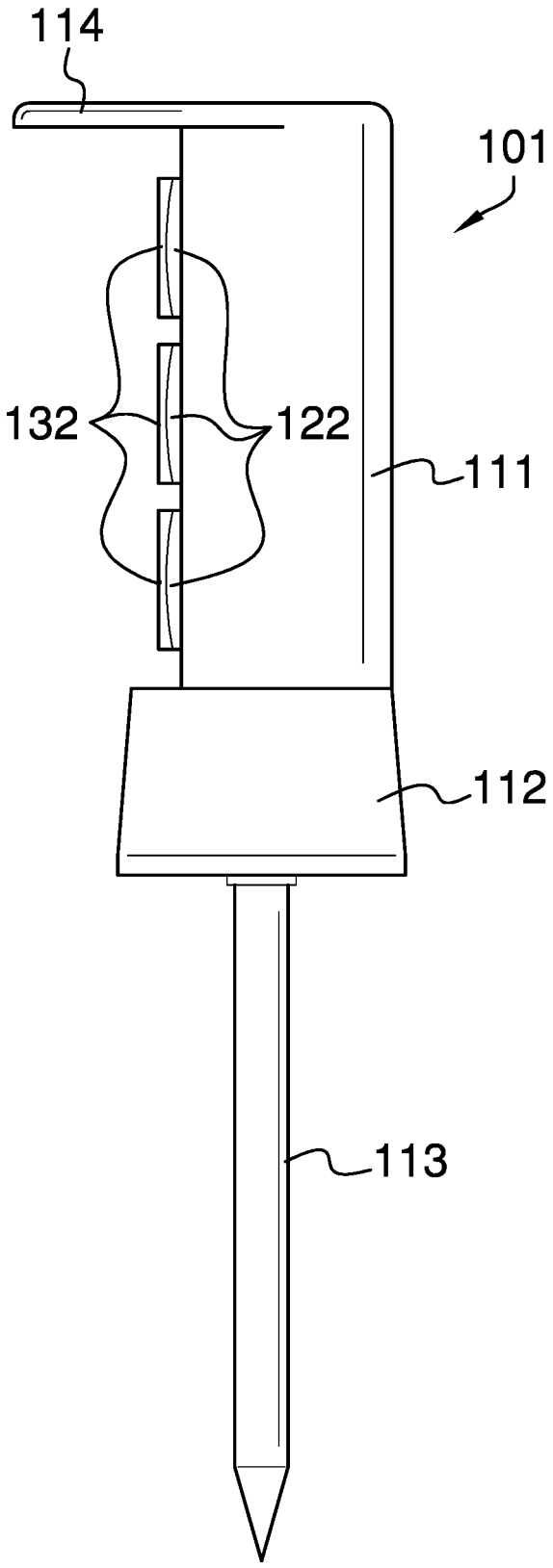
FIG. 2 is a side view of an embodiment of the disclosure.
Figure 3:
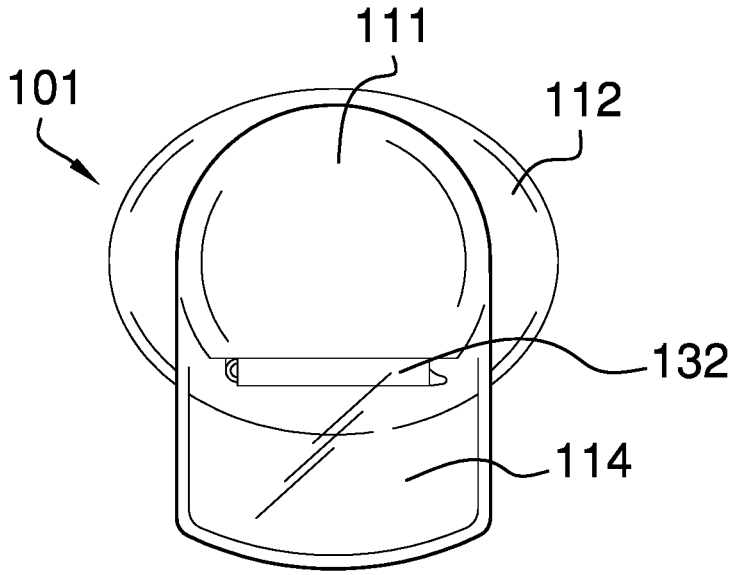
FIG. 3 is a top view of an embodiment of the disclosure.
Figure 4:
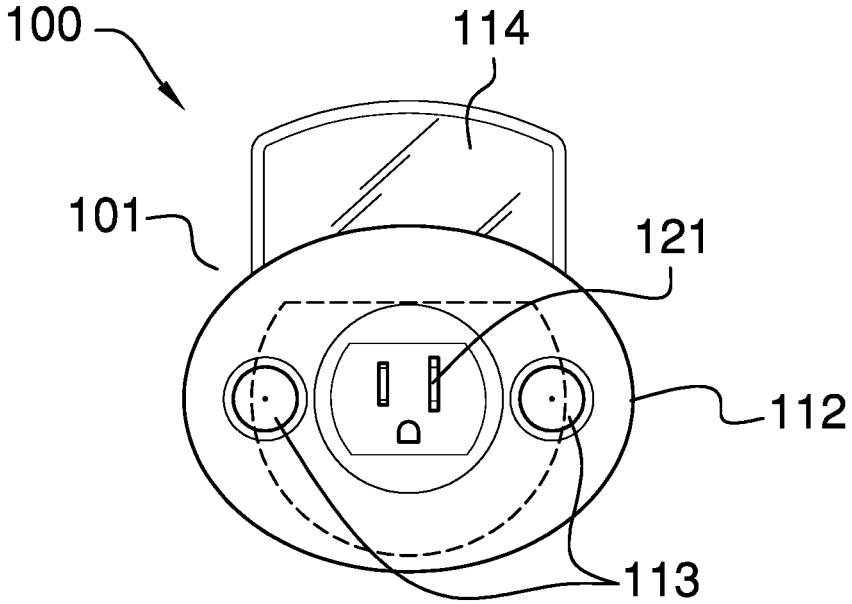
FIG. 4 is a bottom view of an embodiment of the disclosure.
Figure 5:
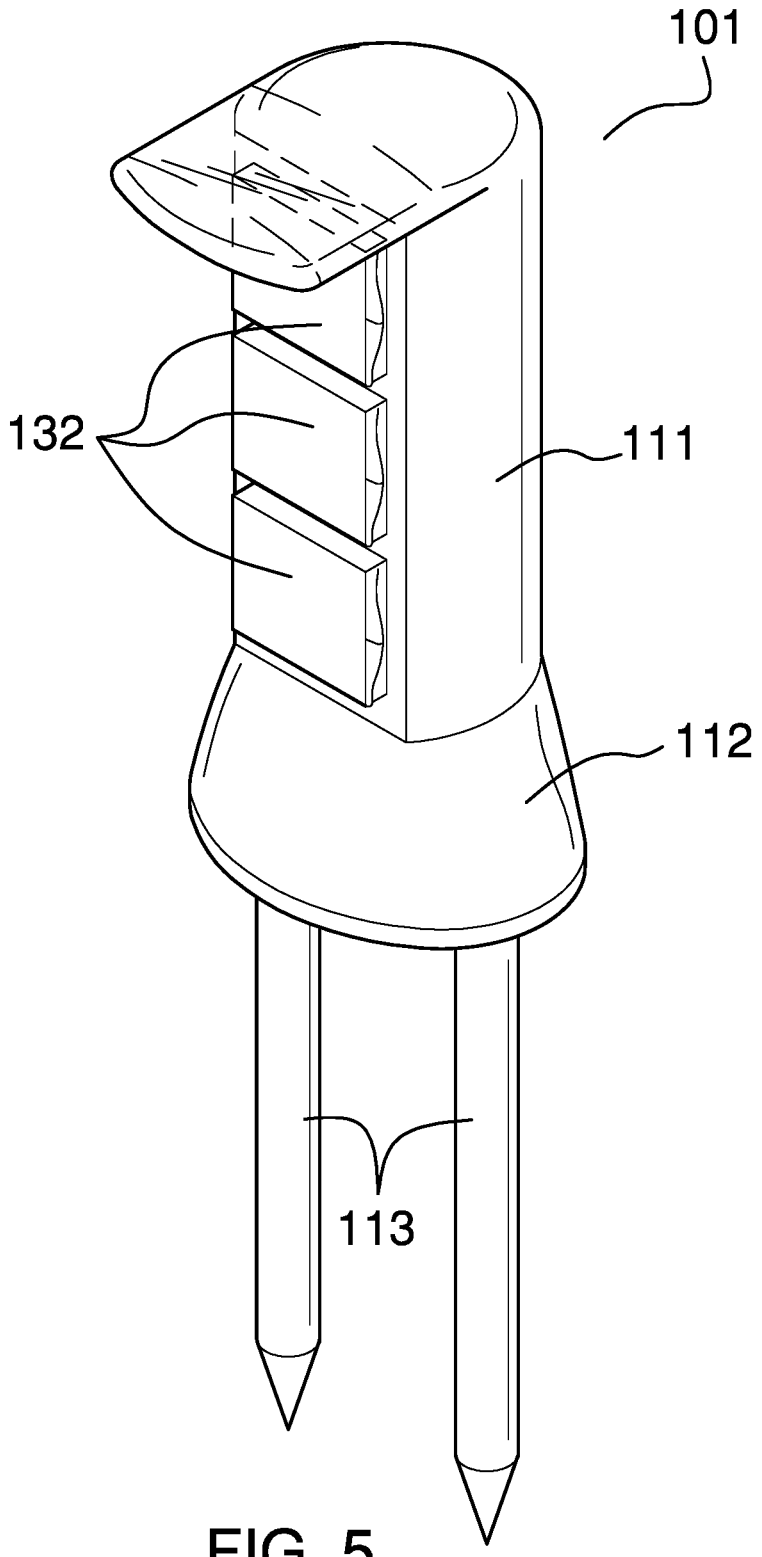
FIG. 5 is a perspective view of an embodiment of the disclosure.
Figure 6:
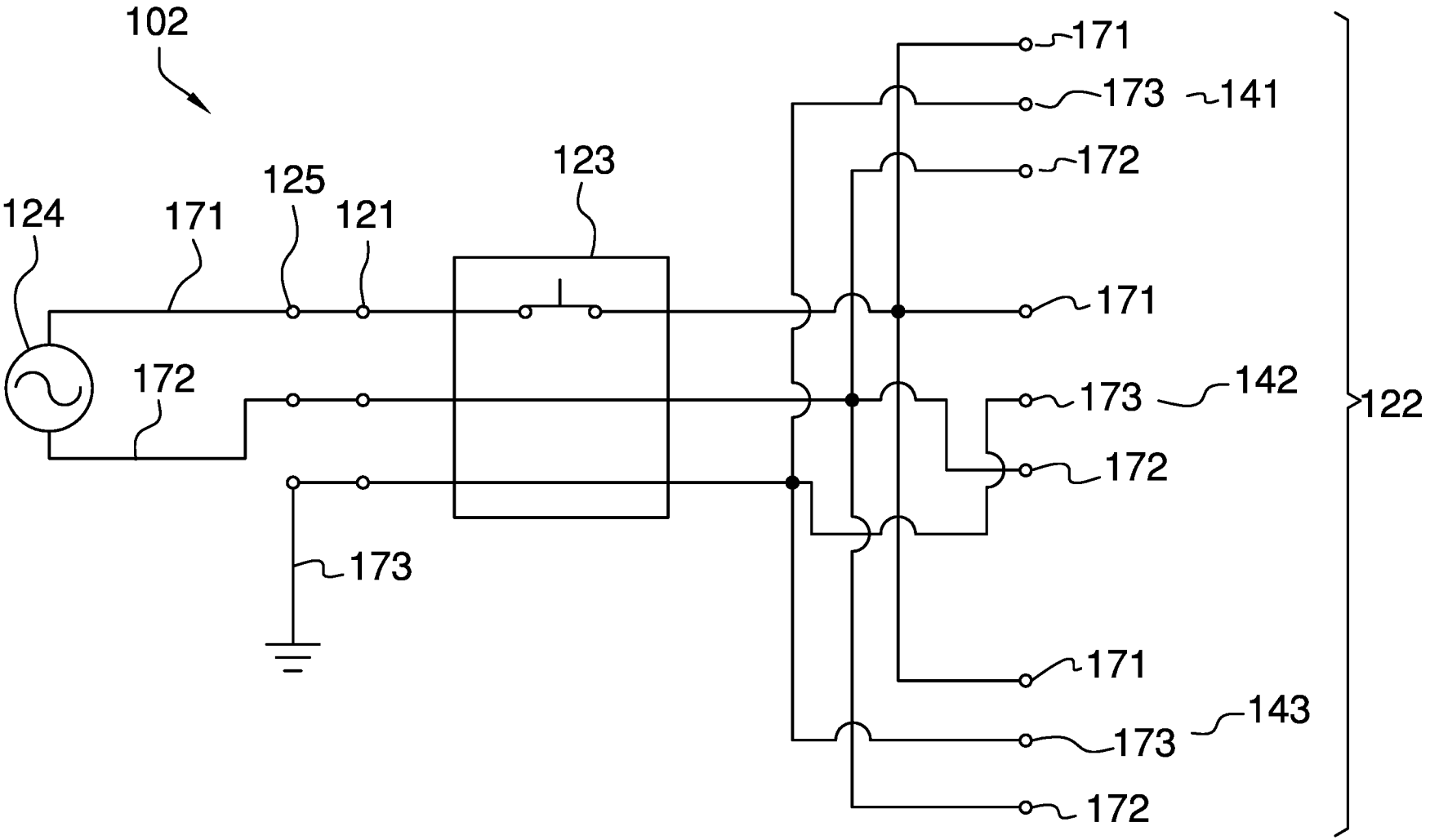
FIG. 6 is a schematic view of an embodiment of the disclosure.

Detailed reference will now be made to one or more potential embodiments of the disclosure, which are illustrated in FIGS. 1 through 6.

The outdoor utility stake 100 (hereinafter invention) is an electric distribution device. The invention 100 is configured for outdoor use. The invention 100 anchors into the ground. The invention 100 draws electric energy from a national electric grid 124. The invention 100 distributes electric energy for use by one or more electrically powered devices. The invention 100 forms a protected space that encloses the electric connection between the national electric grid 124 and the invention 100. The invention 100 comprises a distribution structure 101 and a transfer circuit 102. The distribution structure 101 contains the transfer circuit 102. The distribution structure 101 forms the protected space used to form the protected space that encloses the electric connection between the national electric grid 124 and the invention 100. The transfer circuit 102 electrically connects to the national electric grid 124. The transfer circuit 102 transfers the received electric energy to the one or more electrically powered devices.

The distribution structure 101 is a composite prism structure. The distribution structure 101 anchors the invention 100 into the ground. The distribution structure 101 forms a mechanical structure that protects the transfer circuit 102 from the weather. The distribution structure 101 further forms a protected space that encloses the electric connection between the transfer circuit 102 and the national electric grid 124. The distribution structure 101 is a rigid casing. The distribution structure 101 contains the transfer circuit 102. The distribution structure 101 is formed with all apertures and form factors necessary to allow the distribution structure 101 to accommodate the use and operation of the transfer circuit 102. Methods to form a distribution structure 101 suitable for the purposes described in this disclosure are well-known and documented in the mechanical arts. The distribution structure 101 comprises a port chamber 111, a skirt 112, and a plurality of stakes 113.

The port chamber 111 is a prism-shaped structure. The port chamber 111 is a hollow structure. The port chamber 111 is a rigid casing. The port chamber 111 contains the transfer circuit 102. The port chamber 111 is formed with all apertures and form factors necessary to allow the port chamber 111 to accommodate the use and operation of the transfer circuit 102. Methods to form a port chamber 111 suitable for the purposes described in this disclosure are well-known and documented in the mechanical arts. The port chamber 111 further comprises a plurality of electric socket 122 apertures 131, a plurality of electric socket 122 caps 132, and a port canopy 114.

Each of the plurality of electric socket 122 apertures 131 is an aperture that is formed through the lateral face of the port chamber 111. Each of the plurality of electric socket 122 apertures 131 is positioned underneath the port canopy 114. Each of the plurality of electric socket 122 apertures 131 is sized to receive an electric socket selected from the plurality of electric sockets 122 such that the selected electric socket is accessible to the one or more electrically powered devices. The plurality of electric socket 122 apertures 131 comprises a first electric socket 141 aperture 151, a second electric socket 142 aperture 152, and a third electric socket 143 aperture 153.

The first electric socket 141 aperture 151 is an aperture that is formed through the lateral face of the port chamber 111 of the distribution structure 101. The first electric socket 141 aperture 151 is sized to receive the first electric socket 141. The first electric socket 141 aperture 151 presents the first electric socket 141 to the exterior of the port chamber 111 such that the first electric socket 141 is accessible to the one or more electrically powered devices.

The second electric socket 142 aperture 152 is an aperture that is formed through the lateral face of the port chamber 111 of the distribution structure 101. The second electric socket 142 aperture 152 is sized to receive the second electric socket 142. The second electric socket 142 aperture 152 presents the second electric socket 142 to the exterior of the port chamber 111 such that the second electric socket 142 is accessible to the one or more electrically powered devices.

The third electric socket 143 aperture 153 is an aperture that is formed through the lateral face of the port chamber 111 of the distribution structure 101. The third electric socket 143 aperture 153 is sized to receive the third electric socket 143. The third electric socket 143 aperture 153 presents the third electric socket 143 to the exterior of the port chamber 111 such that the third electric socket 143 is accessible to the one or more electrically powered devices.

Each of the plurality of electric socket 122 caps 132 is a cap. Each of the plurality of electric socket 122 caps 132 is a rotating structure. Each of the plurality of electric socket 122 caps 132 attaches to the lateral face of the port chamber 111. Each of the plurality of electric socket 122 caps 132 encloses an electric socket aperture selected from the plurality of electric socket 122 apertures 131. Each electric socket cap selected from the plurality of electric socket 122 caps 132 rotates from a position that encloses the selected electric socket aperture to an open position that provides exterior access to the electric socket mounted in the selected electric socket aperture. The plurality of electric socket 122 caps 132 comprises a first electric socket 141 cap 161, a second electric socket 142 cap 162, and a third electric socket 143 cap 163.

The first electric socket 141 cap 161 is a rotating structure that attaches to the lateral face of the port chamber 111. The first electric socket 141 cap 161 rotates from a position that encloses the first electric socket 141 to a position such that the first electric socket 141 is accessible to the one or more electrically powered devices.

The second electric socket 142 cap 162 is a rotating structure that attaches to the lateral face of the port chamber 111. The second electric socket 142 cap 162 rotates from a position that encloses the second electric socket 142 to a position such that the second electric socket 142 is accessible to the one or more electrically powered devices.

The third electric socket 143 cap 163 is a rotating structure that attaches to the lateral face of the port chamber 111. The third electric socket 143 cap 163 rotates from a position that encloses the third electric socket 143 to a position such that the third electric socket 143 is accessible to the one or more electrically powered devices.

The port canopy 114 is a rigid structure that attaches to the superior congruent end of the port chamber 111. The port canopy 114 projects away from the center axis of the prism structure of the port chamber 111 such that the port canopy 114 forms a weather-protected space around the plurality of electric sockets 122 of the transfer circuit 102.

The skirt 112 is a pyramid-shaped structure. The skirt 112 is a hollow structure. The skirt 112 attaches to the port chamber 111 to form a composite prism structure. The skirt 112 has a truncated pyramid shape. The truncated apex end of the pyramid structure of the skirt 112 attaches to the inferior congruent end of the prism structure of the port chamber 111 such that the lateral face of the skirt 112 forms a weather-protected space as between the port chamber 111 and the ground.

Each of the plurality of stakes 113 is a spit structure. The spit is defined elsewhere in this disclosure. Each of the plurality of stakes 113 attaches to the inferior congruent end of the prism structure of the port chamber 111 such that the center axis of the spit structure is parallel to the center axis of the composite prism structure of the distribution structure 101. The apex of each of the plurality of stakes 113 forms the inferior structure of the distribution structure 101. Each of the plurality of stakes 113 are driven into the ground such that the distribution structure 101 is anchored to the ground.

The transfer circuit 102 is an electric circuit. The transfer circuit 102 is a power distribution circuit. The transfer circuit 102 draws electric energy from the national electric grid 124. The transfer circuit 102 transfers the received electric energy to the one or more electrically powered devices. The transfer circuit 102 is a self-protecting circuit. By self-protecting is meant that the transfer circuit 102 monitors the electric current flow through the transfer circuit 102 and automatically discontinues the operation of the transfer circuit 102 when all of the current flowing through the transfer circuit 102 cannot be accounted for. The transfer circuit 102 comprises a transfer plug 121, a plurality of electric sockets 122, a ground fault interrupter circuit breaker 123, and a national electric grid 124. The transfer plug 121, the plurality of electric sockets 122, the ground fault interrupter circuit breaker 123, the national electric grid 124, and the national electric grid 124 port 125 are electrically interconnected.

The transfer plug 121 is an electric plug. The transfer plug 121 electrically connects to the national electric grid 124. The transfer plug 121 draws electric energy from the national electric grid 124 through the national electric grid 124 port 125. The transfer plug 121 mounts in the inferior congruent end of the port chamber 111 of the distribution structure 101. The transfer plug 121 is accessible to the national electric grid 124 from within the protected space formed by the skirt 112 of the distribution structure 101.

Each of the plurality of electric sockets 122 is an electric port. Each of the plurality of electric sockets 122 forms an electric connection with each of the one or more electrically powered devices. Each of the plurality of electric sockets 122 transfers the electric energy received from the national electric grid 124 to the one or more electrically powered devices. Each of the one or more electrically powered devices plugs into an electric socket selected from the plurality of electric sockets 122 to form the electric connection. In the first potential embodiment of the disclosure, each of the plurality of electric sockets 122 is a NEMA 5-15 electrical socket. The NEMA 5-15 electrical socket is defined elsewhere in this disclosure. The plurality of electric sockets 122 comprises a first electric socket 141, a second electric socket 142, and a third electric socket 143.

The first electric socket 141 is an electric plug. The first electric socket 141 provides ac electric energy to the one or more electrically powered devices that are electrically connected to the first electric socket 141.

The second electric socket 142 is an electric plug. The second electric socket 142 provides ac electric energy to the one or more electrically powered devices that are electrically connected to the second electric socket 142.

The third electric socket 143 is an electric plug. The third electric socket 143 provides ac electric energy to the one or more electrically powered devices that are electrically connected to the third electric socket 143.

In the first potential embodiment of the disclosure, the first electric socket 141 is a NEMA 5-15 electrical socket. The second electric socket 142 is a NEMA 5-15 electrical socket. The third electric socket 143 is a NEMA 5-15 electrical socket.

The ground fault interrupter circuit breaker 123 is an electric circuit. The ground fault interrupter circuit breaker 123 forms an electric connection between the transfer plug 121 and each of the plurality of electric sockets 122. The ground fault interrupter circuit breaker 123 acts as a ground fault interrupter. The ground fault interrupter is defined elsewhere in this disclosure. The ground fault interrupter circuit breaker 123 monitors the electric current flow through the plurality of electric sockets 122. The ground fault interrupter circuit breaker 123 interrupts the flow of electricity into the plurality of electric sockets 122 when the ground fault interrupter circuit breaker 123 detects a current imbalance flowing through the plurality of electric sockets 122.

The national electric grid 124 is a commercially available source of ac electric energy. The national electric grid 124 is defined elsewhere in this disclosure.

The national electric grid 124 further comprises a national electric grid 124 port 125. The transfer plug 121 inserts into the national electric grid 124 port 125 to electrically connect the national electric grid 124 to the balance of the transfer circuit 102. The national electric grid 124 port 125 is an electric port. The national electric grid 124 port 125 electrically connects the transfer plug 121 and the balance of the transfer circuit 102 to the national electric grid 124.

The national electric grid 124 presents the ac electric voltage as a hot lead 171, a neutral lead 172, and a ground lead 173. The hot lead 171 and the neutral lead 172 provide the ac electric energy to the national electric grid 124 port 125. The ground lead 173 is a safety connection that transfers electric energy to an electrical ground in an emergency. The hot lead 171, the neutral lead 172, and the electrical ground are defined elsewhere in this disclosure.

The following definitions were used in this disclosure:

AC: As used in this disclosure, AC is an acronym for alternating current.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Apex: As used in this disclosure, an apex is a vertex that forms an extreme or solitary point of an object.

Brink: As used in this disclosure, a brink refers to the edge or line formed by the intersection of a first plane or surface and a second plane or surface wherein a cant exists between the first plane or surface and the second plane or surface.

Canopy: As used in this disclosure, a canopy is a cover that is placed above a space to create protected space.

Cap: As used in this disclosure, a cap is a protective cover that encloses a space or opening.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Circuit Breaker: As used in this disclosure, a circuit breaker is a normally closed maintained switch that automatically actuates to an open position should a dangerous condition (such as overcurrent or ground fault) be detected.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Electric Circuit: As used in this disclosure, an electric circuit is a closed loop path through which electrons flow. The closed loop will generally initiate and terminate at an electrical power source.

Electrical Ground: As used in this disclosure, an electrical ground is a common reference voltage that is used in the design and implementation of electrical circuits. An electrical ground is often, but not necessarily, the discharge point of electric currents flowing through an electric circuit.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Ground: As used in this disclosure, the ground is a solid supporting surface formed by the Earth. The term level ground means that the supporting surface formed by the ground is roughly perpendicular to the force of gravity.

Ground Fault Interrupter: As used in this disclosure, a ground fault interrupter is a circuit breaker that is actuated when a "ground fault" is detected. The ground fault interrupter is inserted into a protected electrical circuit such that all authorized electrical currents entering and leaving the protected electrical circuit are routed through the ground fault interrupter. The ground fault interrupter detects the ground fault by comparing the current entering protected electrical circuit through the ground fault interrupter and the current exiting the protected electrical circuit through the ground fault interrupter. Should a current mismatch be detected the ground fault interrupter actuates to the open position. A ground fault interrupter is also referred to as a ground fault circuit interrupter. A ground fault interrupter is often called a GFCI.

Hinge: As used in this disclosure, a hinge is a device that permits the turning, rotating, or pivoting of a first object relative to a second object. A hinge designed to be fixed into a set position after rotation is called a locking hinge. A spring loaded hinge is a hinge formed as an elastic structure. The elastic structure of the spring loaded hinge is deformed under a rotating force such that the elastic structure returns the spring loaded hinge back to its relaxed shape after the rotating force is removed from the spring loaded hinge.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Hot Lead and Neutral Lead: As used in this disclosure, a hot lead is the source of the electric current that is provided by an ac voltage source. A neutral lead is the return for the electric current that is provisioned through the hot lead back to the ac voltage source.

Housing: As used in this disclosure, a housing is a rigid structure that encloses and protects one or more devices.

Inferior: As used in this disclosure, the term inferior refers to a directional reference that is parallel to and in the same direction as the force of gravity when an object is positioned or used normally.

National Electric Grid: As used in this disclosure, the national electric grid is a synchronized and highly interconnected electrical network that distributes energy in the form of electric power from a plurality of generating stations to consumers of electricity. The national electric grid is a commercially available source of AC electrical power. The national electric grid is regulated by an appropriate authority. The national electric grid sells electrical power for use by an electrical load. The national electric grid invoices for electrical power based on the total energy consumed by the electrical load. The national electric grid measures the energy consumption of an electrical load with an electrical meter.

Negative Space: As used in this disclosure, negative space is a method of defining an object through the use of open or empty space as the definition of the object itself, or, through the use of open or empty space to describe the boundaries of an object.

NEMA: As used in this disclosure, NEMA is an acronym for National Electric Manufacturers Association. NEMA is a manufacturer's association known for publishing widely accepted technical standards regarding the performance of electrical power distribution equipment.

NEMA 5-15 Electrical Socket: As used in this disclosure, the NEMA 5-15 electrical socket is a port designed to provide electric power drawn from a source of electrical power consistent with the electrical power received through the National Electric Grid. The NEMA 5-15 electrical socket is commonly used to deliver electrical power to electric devices in residential, office, and light industrial settings. The typical NEMA 5-15 electrical socket comprises a plurality of electric ports from which electric power is drawn. The position of each of the plurality of electric ports is placed in a standardized position. The typical NEMA 5-15 electrical socket further comprises a plate hole which is a standardized hole located in a standardized position within the NEMA 5-15 electrical socket that is designed to receive a bolt that is used to attach a faceplate to the NEMA 5-15 electrical socket. The NEMA 5-15 electrical socket is also commonly referred to as an electrical outlet.

NEMA 5-15P Electrical Plug: As used in this disclosure, the NEMA 5-15P Electrical Plug is a plug that is designed to be inserted into a NEMA 5-15 Electrical Socket for the purpose of delivering electrical power to electrical devices. The NEMA 5-15P Electrical Plug is a 3 blade plug that is commonly found within residential and office environments within the United States.

N-gon: As used in this disclosure, an N-gon is a regular polygon with N sides wherein N is a positive integer number greater than 2.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Perimeter: As used in this disclosure, a perimeter is one or more curved or straight lines that bounds an enclosed area on a plane or surface. The perimeter of a circle is commonly referred to as a circumference.

Pivot: As used in this disclosure, a pivot is a rod or shaft around which an object rotates or swings.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Space: As used in this disclosure, a protected space is a space formed by a boundary structure. The boundary structure forms a barrier that protects objects within the protected space from potential dangers from the other side of the boundary.

Pyramid: As used in this disclosure, a pyramid is a three-dimensional shape that comprises a base formed in the shape of an N-gon (wherein N is an integer) with N triangular faces that rise from the base to converge at a point above the base. The center axis of a pyramid is the line drawn from the vertex where the N faces meet to the center of the N-gon base. The center axis of a right pyramid is perpendicular to the N-gon base. Pyramids can be further formed with circular or elliptical bases which are commonly referred to as a cone or an elliptical pyramid respectively. A pyramid is defined with a base, an apex, and a lateral face. The base is the N-gon shaped base described above. The apex is the vertex that defines the center axis. The lateral face is formed from the N triangular faces described above.

Semi-Enclosed Prism: As used in this disclosure, a semi-enclosed prism is a prism-shaped structure wherein a portion of the lateral face of the prism-shaped is removed or otherwise replaced with a negative space. Always use negative space.

Skirt: As used in this disclosure, a skirt is a structure that attaches to the inferior region of an object such that the skirt forms a protected space inferior to the object.

Sharp: As used in this disclosure, the term sharp refers to an apex or a brink that is formed in a first structure that is capable of puncturing or cutting a second structure.

Socket: As used in this disclosure, a socket is an electrical device that 1) forms an opening or a cavity that acts as a receptacle for an inserted object; and, 2) is designed to receive or transfer electricity to or from the object inserted in the socket.

Spit: As used in this disclosure, a spit refers to a composite prism structure formed by the combination of a prism and a pyramid such that the apex of the pyramid forms a point capable of pushing through the surface of a second structure.

Stake: As used in this disclosure, a stake is a shaft that is driven into a horizontal surface, such as the ground, to serve as an anchor point.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Truncated: As used in this disclosure, a geometric object is truncated when an apex, vertex, or end is cut off by a line or plane.

Truncated Pyramid: As used in this disclosure, a truncated pyramid is a frustum that remains when the apex of a pyramid is truncated by a plane that is parallel to the base of the pyramid.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Weather: As used in this disclosure, the term weather refers to a collection of measurable parameters of the atmosphere including, but not limited to, temperature, humidity, precipitation, and air movement caused by wind and energy and illumination from the sun. A structure that isolates an individual or object from the more uncomfortable or destructive aspects of the weather is said to provide protection against the weather. The term elements is often used to refer to weather.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An outdoor utility stake comprising
wherein the outdoor utility stake comprises a distribution structure and a transfer circuit;
wherein the distribution structure contains the transfer circuit;
wherein the outdoor utility stake is an electric distribution device;
wherein the outdoor utility stake is configured for outdoor use;
wherein the outdoor utility stake anchors into the ground;
wherein the outdoor utility stake distributes electric energy for use by one or more electrically powered devices;
wherein the outdoor utility stake forms a protected space that encloses the electric connection between a national electric grid and the outdoor utility stake;
wherein the distribution structure comprises a port chamber, a skirt, and a plurality of stakes;
wherein the skirt and the plurality of stakes attach to the port chamber;
wherein the port chamber further comprises a plurality of electric socket apertures, a plurality of electric socket caps, and a port canopy;
wherein each of the plurality of electric socket apertures is an aperture that is formed through the lateral face of the port chamber;
wherein each of the plurality electric socket caps attaches to the port chamber;
wherein the port canopy attaches to the port chamber;
wherein each of the plurality of electric socket caps is a cap;
wherein each of the plurality of electric socket caps is a rotating structure;
wherein each of the plurality of electric socket caps attaches to the lateral face of the port chamber;
wherein each of the plurality of electric socket caps encloses an electric socket aperture selected from the plurality of electric socket apertures.

2. The outdoor utility stake according to claim 1 wherein the distribution structure forms the protected space used to form the protected space that encloses the electric connection between the national electric grid and the outdoor utility stake.

3. The outdoor utility stake according to claim 2
wherein the transfer circuit electrically connects to a national electric grid;
wherein the transfer circuit transfers the received electric energy to the one or more electrically powered devices.

4. The outdoor utility stake according to claim 3
wherein the distribution structure is a composite prism structure;
wherein the distribution structure anchors the outdoor utility stake into the ground;
wherein the distribution structure forms a mechanical structure that protects the transfer circuit from the weather;
wherein the distribution structure further forms a protected space that encloses the electric connection between the transfer circuit and the national electric grid.

5. The outdoor utility stake according to claim 4 wherein the distribution structure is a rigid casing.

6. The outdoor utility stake according to claim 5
wherein the port chamber is a prism-shaped structure;
wherein the port chamber is a hollow structure;
wherein the port chamber is a rigid casing;
wherein the port chamber contains the transfer circuit.

7. The outdoor utility stake according to claim 6 wherein each of the plurality of electric socket apertures is positioned underneath the port canopy.

8. The outdoor utility stake according to claim 7 wherein each electric socket cap selected from the plurality of electric socket caps rotates from a position that encloses the selected electric socket aperture to an open position that provides exterior access to an electric socket mounted in the selected electric socket aperture.

9. The outdoor utility stake according to claim 8
wherein the port canopy is a rigid structure that attaches to the superior congruent end of the port chamber;
wherein the electric socket is a plurality of electric sockets;
wherein the port canopy projects away from the center axis of the prism structure of the port chamber such that the port canopy forms a weather-protected space around the plurality of electric sockets of the transfer circuit.

10. The outdoor utility stake according to claim 9
wherein the skirt is a pyramid-shaped structure;
wherein the skirt is a hollow structure;
wherein the skirt attaches to the port chamber to form a composite prism structure.

11. The outdoor utility stake according to claim 10
wherein the skirt has a truncated pyramid shape;
wherein the truncated apex end of the pyramid structure of the skirt attaches to the inferior congruent end of the prism structure of the port chamber such that the lateral face of the skirt forms a weather-protected space as between the port chamber and the ground.

12. The outdoor utility stake according to claim 11
wherein each of the plurality of stakes is a spit structure;
wherein each of the plurality of stakes attaches to the inferior congruent end of the prism structure of the port chamber such that the center axis of the spit structure is parallel to the center axis of the composite prism structure of the distribution structure;
wherein the apex of each of the plurality of stakes forms the inferior structure of the distribution structure;
wherein each of the plurality of stakes are driven into the ground such that the distribution structure is anchored to the ground.

13. The outdoor utility stake according to claim 12
wherein the transfer circuit is an electric circuit;
wherein the transfer circuit is a power distribution circuit;
wherein the transfer circuit draws electric energy from the national electric grid;

wherein the transfer circuit transfers the received electric energy to the one or more electrically powered devices;

wherein the transfer circuit is a self-protecting circuit;

wherein by self-protecting is meant that the transfer circuit monitors the electric current flow through the transfer circuit and automatically discontinues the operation of the transfer circuit when all of the current flowing through the transfer circuit cannot be accounted for.

14. The outdoor utility stake according to claim 13 wherein the transfer circuit comprises a transfer plug, the plurality of electric sockets, a ground fault interrupter circuit breaker, and the national electric grid;

wherein the transfer plug, the plurality of electric sockets, the ground fault interrupter circuit breaker, the national electric grid, and a national electric grid port are electrically interconnected.

15. The outdoor utility stake according to claim 14 wherein the transfer plug is an electric plug;

wherein the transfer plug electrically connects to the national electric grid;

wherein the transfer plug draws electric energy from the national electric grid through the national electric grid port;

wherein the transfer plug mounts in the inferior congruent end of the port chamber of the distribution structure;

wherein the transfer plug is accessible to the national electric grid from within the protected space formed by the skirt of the distribution structure;

herein each of the plurality of electric sockets is an electric port;

wherein each of the plurality of electric sockets forms an electric connection with each of the one or more electrically powered devices;

wherein each of the plurality of electric sockets transfers the electric energy received from the national electric grid to the one or more electrically powered devices;

wherein each of the one or more electrically powered devices plugs into an electric socket selected from the plurality of electric sockets to form the electric connection;

wherein the ground fault interrupter circuit breaker is an electric circuit;

wherein the ground fault interrupter circuit breaker forms an electric connection between the transfer plug and each of the plurality of electric sockets;

wherein the ground fault interrupter circuit breaker acts as a ground fault interrupter;

wherein the ground fault interrupter circuit breaker monitors the electric current flow through the plurality of electric sockets;

wherein the ground fault interrupter circuit breaker interrupts the flow of electricity into the plurality of electric sockets when the ground fault interrupter circuit breaker detects a current imbalance flowing through the plurality of electric sockets;

wherein the plurality of electric socket apertures comprises a first electric socket aperture, a second electric socket aperture, and a third electric socket aperture;

wherein the first electric socket aperture is an aperture that is formed through the lateral face of the port chamber of the distribution structure;

wherein the first electric socket aperture is sized to receive the first electric socket;

wherein the first electric socket aperture presents the first electric socket to the exterior of the port chamber such that the first electric socket is accessible to the one or more electrically powered devices;

wherein the second electric socket aperture is an aperture that is formed through the lateral face of the port chamber of the distribution structure;

wherein the second electric socket aperture is sized to receive the second electric socket;

wherein the second electric socket aperture presents the second electric socket to the exterior of the port chamber such that the second electric socket is accessible to the one or more electrically powered devices;

wherein the third electric socket aperture is an aperture that is formed through the lateral face of the port chamber of the distribution structure;

wherein the third electric socket aperture is sized to receive the third electric socket;

wherein the third electric socket aperture presents the third electric socket to the exterior of the port chamber such that the third electric socket is accessible to the one or more electrically powered devices.

16. The outdoor utility stake according to claim 15 wherein each of the plurality of electric socket apertures is sized to receive an electric socket selected from the plurality of electric sockets such that the selected electric socket is accessible to the one or more electrically powered devices.

17. The outdoor utility stake according to claim 16 wherein the plurality of electric sockets comprises a first electric socket, a second electric socket, and a third electric socket;

wherein the first electric socket is an electric plug;

wherein the first electric socket provides ac electric energy to the one or more electrically powered devices that are electrically connected to the first electric socket;

wherein the second electric socket is an electric plug;

wherein the second electric socket provides ac electric energy to the one or more electrically powered devices that are electrically connected to the second electric socket;

wherein the third electric socket is an electric plug;

wherein the third electric socket provides ac electric energy to the one or more electrically powered devices that are electrically connected to the third electric socket;

wherein the first electric socket is a NEMA 5-15 electrical socket;

wherein the second electric socket is a NEMA 5-15 electrical socket;

wherein the third electric socket is a NEMA 5-15 electrical socket;

wherein the plurality of electric socket caps comprises a first electric socket cap, a second electric socket cap, and a third electric socket cap;

wherein the first electric socket cap is a rotating structure that attaches to the lateral face of the port chamber;

wherein the first electric socket cap rotates from a position that encloses the first electric socket to a position such that the first electric socket is accessible to the one or more electrically powered devices;

wherein the second electric socket cap is a rotating structure that attaches to the lateral face of the port chamber;

wherein the second electric socket cap rotates from a position that encloses the second electric socket to a position such that the second electric socket is accessible to the one or more electrically powered devices;

wherein the third electric socket cap is a rotating structure that attaches to the lateral face of the port chamber;

wherein the third electric socket cap rotates from a position that encloses the third electric socket to a position such that the third electric socket is accessible to the one or more electrically powered devices.

* * * * *